US010681962B1

(12) United States Patent
Fildan et al.

(10) Patent No.: US 10,681,962 B1
(45) Date of Patent: Jun. 16, 2020

(54) MULTI-DIRECTIONAL CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Services Corp., Central (HK)

( * ) Notice: Subject to any disclaimer, the term of this patent is extended or adjusted under 35 U.S.C. 154(b) by 0 days.

(21) Appl. No.: 15/929,124

(22) Filed: Apr. 17, 2019

(30) Foreign Application Priority Data

Apr. 5, 2019 (GB) ..... 1904833.9

(51) Int. Cl.

| | |
|---|---|
| ***A44B 1/00*** | (2006.01) |
| ***A44B 17/00*** | (2006.01) |
| ***A44B 1/08*** | (2006.01) |
| ***A44B 1/34*** | (2006.01) |

(52) U.S. Cl.
CPC ..... *A44B 1/08* (2013.01); *A44B 1/34* (2013.01); *A44B 17/007* (2013.01); *A44B 17/0041* (2013.01); *A44B 17/0076* (2013.01)

(58) Field of Classification Search
CPC ..... A44B 1/08; A44B 1/34; A44B 17/0041; A44B 17/007; A44B 17/0076; A44B 1/00; A44B 1/04; A44B 17/00; A44B 17/0023; A44B 17/0052; A44B 17/0064; A44B 17/0029; A44B 17/0035; A44B 17/0082; A44B 17/0088; Y10T 24/36; Y10T 24/3683; Y10T 24/3685; Y10T 24/3694; Y10T 24/32
See application file for complete search history.

(56) References Cited

U.S. PATENT DOCUMENTS

| | | | | |
|---|---|---|---|---|
| 8,935,835 | B2 | 1/2015 | Fildan et al. | |
| 9,101,185 | B1 * | 8/2015 | Greenberg | A44C 5/20 |
| 2003/0005558 | A1 | 1/2003 | Wong | |
| 2012/0060330 | A1 | 3/2012 | Fildan et al. | |
| 2012/0174346 | A1 | 7/2012 | Fildan et al. | |

(Continued)

FOREIGN PATENT DOCUMENTS

| | | | |
|---|---|---|---|
| DE | 20018405 | U1 | 1/2001 |
| EP | 1488714 | A1 | 12/2004 |

(Continued)

OTHER PUBLICATIONS

UKIPO Search Report in priority application GB1904833.9, dated Oct. 8, 2019, 3p.

*Primary Examiner* — Jack W Lavinder
(74) *Attorney, Agent, or Firm* — Kintner IP LLC; Mary Frances Ludwig

(57) ABSTRACT

A multi-directional closure for securing two pieces together includes a male part and a female part. The male part has a central, main protuberance and a plurality of outer protuberances. The female part has a seat cavity including a plurality of inwardly depending catch faces. The female part further includes a plurality of outwardly depending catch faces. In embodiments, the male part and the female part may each be provided with a magnet to align the main protuberance with the seat cavity. The closure is capable of withstanding high levels of radial forces in all radial directions without being disconnected. This allows for easier use of the closure and also greatly facilitates manufacture of items using the closure.

16 Claims, 4 Drawing Sheets

(56) References Cited

U.S. PATENT DOCUMENTS

| | | | | |
|---|---|---|---|---|
| 2015/0074954 | A1* | 3/2015 | Pruitt | A44C 5/2071 24/303 |
| 2018/0140031 | A1 | 5/2018 | Fildan et al. | |

FOREIGN PATENT DOCUMENTS

| | | | | | |
|---|---|---|---|---|---|
| EP | 2301372 | A1 | | 3/2011 | |
| GB | 581096 | A | * | 10/1946 | A44B 17/0052 |
| WO | 2013008340 | A1 | | 1/2013 | |

* cited by examiner

MULTI-DIRECTIONAL CLOSURE

CROSS REFERENCE TO RELATED APPLICATION

This application claims foreign priority to GB Patent Application No. 1904833.9, filed in the United Kingdom on 5 Apr. 2019.

TECHNICAL FIELD

The present invention pertains generally to closures, and more particularly to a multi-directional closure for securing two pieces together and a garment having the closure.

BACKGROUND OF THE INVENTION

There are many different types of closures available in the marketplace today. Depending on the intended function and specification of the closure (i.e. the force that the closure must be able to withstand, the direction of forces the closure will be subjected to, the weight of the closure, the size of the closure, the materials of the closure and the like), the correct closure must be selected for the particular application. For example, brassieres typically incorporate hook and eye type closures, trousers and shirts often incorporate through button-type closures, and infant garments typically incorporate snap-fit type closures. The present invention is directed to a closure of the type that may be used on garments, such as jackets, or articles, such as satchels.

Closures that are used on garments or other articles, such as satchels, are ideally capable of withstanding forces in any radial direction without inadvertent release of the closure. Furthermore, these closures are required to provide a secure engagement, as they are often subjected to relatively large applied forces. This second requirement often results in closures being provided that are designed to withstand forces in a limited range of directions, as these types of closures are better suited to withstanding higher forces. However, these types of closures can be inadvertently opened once a force is applied in the opposite or different direction to the normally-applied force. Therefore, there is often a trade-off between the level of separation force that can be resisted and the direction of separation forces that can be effectively resisted.

In addition to the foregoing, if omni-directional closures are not used, these closures increase the cost and time to manufacture the item, as the closures will have to be carefully aligned on the item before being connected to the item by stitching or welding. Finally, if omni-directional closures are not used, these closures are often much harder to align and manipulate than the omni-directional closures. This renders them unsuitable for certain applications, including those for young children and those with dexterity problems.

It is an object of the present invention to provide a closure that overcomes at least some of the above-identified problems. In particular, it is an object of the present invention to provide a closure that is capable of withstanding relatively high separating forces in all radial directions that is also simple to manipulate. It is a further object of the present invention to provide a useful alternative choice of closure to the public.

BRIEF SUMMARY OF THE EMBODIMENTS

Embodiments disclosed herein are directed to a multi-directional closure for securing two pieces together which includes:

a female part configured to be mounted on one of the pieces and a male part configured to be mounted on the other of the pieces;

the female part includes an upwardly open seat cavity, the seat cavity having an internal diameter that increases from an entrance of the seat cavity towards a base of the seat cavity;

the male part includes a downwardly projecting main protuberance, the main protuberance having a diameter that increases from a base of the main protuberance towards a head of the main protuberance;

the female part further includes four inwardly depending catch faces and four outwardly depending catch faces, the four inwardly depending catch faces being located at the entrance of the seat cavity, circumferentially spaced around the entrance of the seat cavity with respect to each other, and configured for releasable engagement of a side wall of the main protuberance of the male part, the four outwardly depending catch faces extending radially outwardly from the entrance of the seat cavity and being circumferentially spaced around the entrance of the seat cavity with respect to each other; and the male part further including four downwardly projecting outer protuberances evenly spaced apart from each other around the main protuberance, each of the outer protuberances having a catch face for complementary releasable engagement of one of the outwardly depending catch faces of the female part.

Such a closure is capable of withstanding separating forces in all radial directions. In this way, a more secure closure is provided, as the closure will not have a tendency to inadvertently open if force is applied in a given radial direction, particularly in a direction opposite to, or different from, the normal direction of force applied to the closure. Furthermore, this introduces new possibilities for the application of the closure. It is envisaged that such a closure will be particularly suitable for jackets, bags, and the like. Advantageously, by having a closure that can withstand separating forces in all radial directions, the closure can be placed in any orientation on a garment or other item during manufacture without adversely affecting the efficacy of the closure. This will facilitate and speed up the manufacture of the garments or items.

According to one or more embodiments, there is provided a closure for securing two pieces together in which the female part has a female magnet adjacent a base of the seat cavity, and the male part has a male magnet adjacent a head of the main protuberance for releasable engagement of the female magnet. The magnets of the closure will have a self-centering effect, thereby making the closure easier to manipulate. This will be particularly beneficial for less dexterous users of the closure, including the young and those suffering from arthritis or poor mobility and/or control over their fingers.

According to one or more embodiments, there is provided a closure for securing two pieces together in which the main protuberance is frustoconical in shape. This is seen as a particularly effective configuration of closure. By having a frustoconically shaped main protuberance, the protuberance will have a tendency to more securely engage the cavity of the female part by being driven inwardly into the cavity when a radial force is applied to the male part.

According to one or more embodiments, there is provided a closure for securing two pieces together in which the four inwardly depending catch faces of the female part are offset by about 45° with respect to the outwardly depending catch faces. In this way, this will further secure the closure against forces applied in any radial direction.

According to one or more embodiments, there is provided a closure for securing two pieces together in which the inwardly depending catch faces of the female part each extend between 55° and 65° around the circumference of the entrance of the seat cavity. In this way, there will be some separation between the adjacent inwardly depending catch faces which is advantageous from a molding perspective. However, the adjacent catch faces will be sufficiently close together so that when the main protuberance is pulled in a given radial direction, it will engage a sufficient amount of one of the inwardly depending catch faces or it will engage a sufficient amount to two adjacent catch faces.

According to one or more embodiments, there is provided a closure for securing two pieces together in which the inwardly depending catch faces of the female part each extend 60° around the circumference of the entrance of the seat cavity.

According to one or more embodiments, there is provided a closure for securing two pieces together in which the diameter of the head of the main protuberance is greater than the internal diameter of the entrance to the seat cavity at its narrowest point. By having such a configuration, this will create a snap-fit closure thereby increasing the strength of the connection between the male and female parts.

According to one or more embodiments, there is provided a closure for securing two pieces together in which the diameter of the head of the main protuberance is at least 0.00025 m (0.25 mm) wider than the diameter of the entrance to the seat cavity at its narrowest point.

According to one or more embodiments, there is provided a closure for securing two pieces together in which the diameter of the head of the main protuberance is at least 0.0003 m (0.3 mm) wider than the diameter of the entrance to the seat cavity at its narrowest point.

According to one or more embodiments, there is provided a closure for securing two pieces together in which the male part and the female part each have an outer diameter of between 0.014 m (14 mm) and 0.02 m (20 mm). This will provide a compact yet relatively strong closure that may be used unobtrusively on many disparate types of garments and articles of manufacture.

According to one or more embodiments, there is provided a closure for securing two pieces together in which the male and female parts are each provided with a backing plate. By having a backing plate, the male part and the female parts can be mounted more easily on a garment or other item, thereby simplifying the manufacture of the garment or item.

According to one or more embodiments, there is provided a closure for securing two pieces together in which the magnets are sealed inside the male and female parts. By sealing the magnets, this will obviate the possibility of the magnets rusting and ruining the garment or item, and will allow the garment to be washed rather than dry-cleaned.

According to one or more embodiments, there is provided a closure for securing two pieces together in which there are provided a plurality of female parts.

According to one or more embodiments, there is provided a closure for securing two pieces together in which there are provided a plurality of male parts.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the multi-directional closure are described with reference to the following figures, wherein like reference numerals refer to like parts throughout the various views unless otherwise specified.

Figure 1:
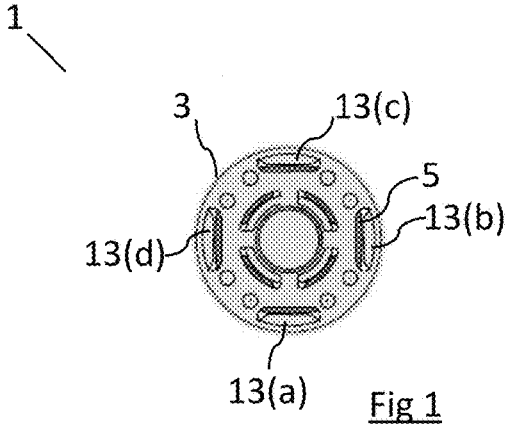
FIG. 1 is a top view of a first embodiment of a closure, in which the closure is in a neutral position.
Figure 2:
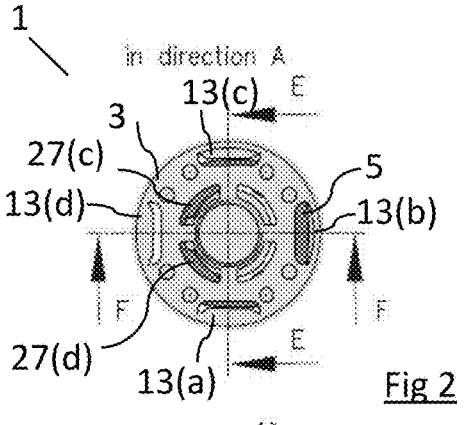
FIG. 2 is a top view of the closure, in which the female part has been moved in the direction of arrow A of FIG. 4.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Referring to FIGS. 1-12 inclusive, there is shown a multi-directional closure, indicated generally by the reference numeral 1, comprising a male part 3 and a female part 5. The male part 3 comprises a downwardly depending main protuberance 7 having a side wall 9 and terminating in a head 11. The male part further comprises a plurality of downwardly depending outer protuberances 13(*a*)-13(*d*) spaced apart from each other and surrounding the main protuberance 7. A backing plate 15 is mounted on the rear of the male part and a magnet 17 may be contained inside the main protuberance 7.

The female part 5 comprises a body defining an upwardly open seat cavity 19 having a side wall 21 and a base 23. The side wall 21 is configured so that the internal diameter of the cavity increases from an open entrance 25 of the cavity inwardly towards the base 23. The female part comprises four inwardly depending catch faces 27(*a*)-27(*d*) and four outwardly depending catch faces 29(*a*)-29(*d*). The inwardly depending catch faces 27(*a*)27(*d*) are spaced apart circumferentially around the entrance 25 to the seat cavity 19 with respect to each other, and are configured to engage with the side wall 9 of the male part 3 when the main protuberance 7 of the male part is inserted into the cavity of the female part and a radial force is applied to one of the male and female parts. The four outwardly depending catch faces 29(*a*)-29(*d*) extend radially outwardly from the entrance 25 to the seat cavity 19 and are circumferentially spaced around the entrance to the seat cavity with respect to each other. The inwardly depending catch faces 27(*a*)-27(*d*) and the outwardly depending catch faces 29(*a*)-29(*d*) are offset with respect to each other by about 45° around the entrance 25 to the seat cavity 19. A magnet 31 may be mounted under the base of the seat cavity and a backing sheet 33 may be provided, thereby encapsulating the magnet 31.

Figure 3:
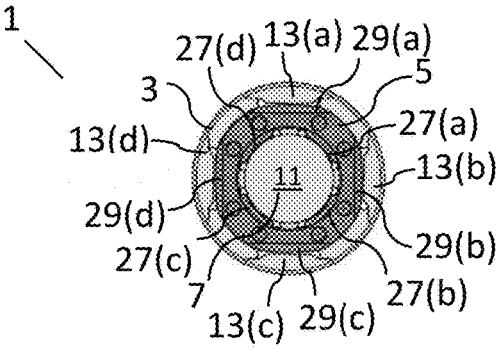
FIG. 3 is a bottom view of the closure of FIG. 1.

In use, the male part 3 and the female part 5 are brought into engagement with each other by inserting the main protuberance 7 of the male part 3 into the open seat cavity 19 of the female part 5. In this position, as illustrated in FIGS. 1 and 3, the closure 1 is said to be in a neutral position in that the only forces holding the male part 3 and the female part 5 together are the attractive forces of the optional magnets 17, 31. It will be appreciated also that the magnets 17, 31 have a self-centering effect that will facilitate the insertion of the main protuberance 7 of the male part 3 into the seat cavity 19 of the female part 5. If a radial force is exerted on one of the male part 3 and the female part 5, e.g. in one of directions A-D of FIG. 4, the side wall 9 of the main protuberance 7 of the male part will come into contact with at least one of the inwardly depending catch faces 27(*a*)-27(*d*) of the female part 5, and at least one of the catch faces of the outer protuberances 13(*a*)-(*d*) of the male part 3 will engage with the at least one of the outwardly depending catch faces 29(*a*)-29(*d*) of the female part 5.

Figure 4:
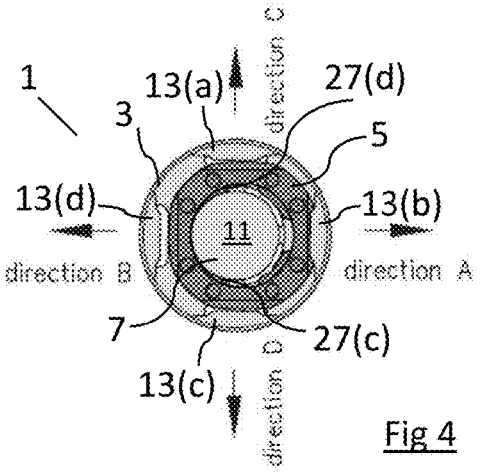
FIG. 4 is a bottom view of the closure of FIG. 2.
Figure 5:
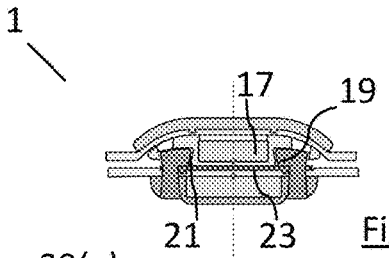
FIG. 5 is a cross-sectional view along the lines E-E of FIG. 2.
Figure 6:
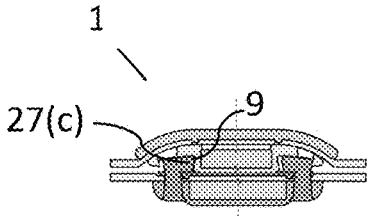
FIG. 6 is a cross-sectional view along the lines F-F of FIG. 2.
Figure 7:
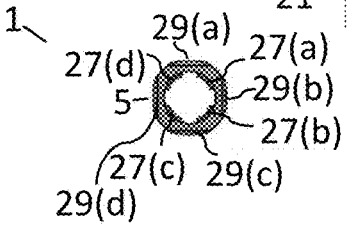
FIG. 7 is a reduced bottom view of a portion of a female part of the closure.
Figure 8:
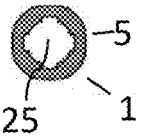
FIG. 8 is a reduced top view of a portion of the female part.
Figure 9:
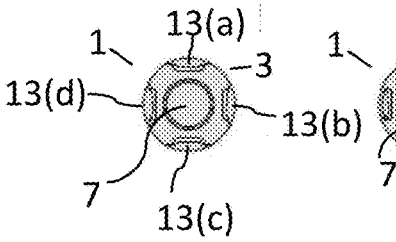
FIG. 9 is a reduced bottom view of a male part of the closure.
Figure 10:
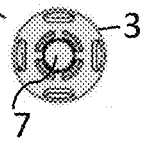
FIG. 10 is a reduced top view of the male part.
Figure 11A:
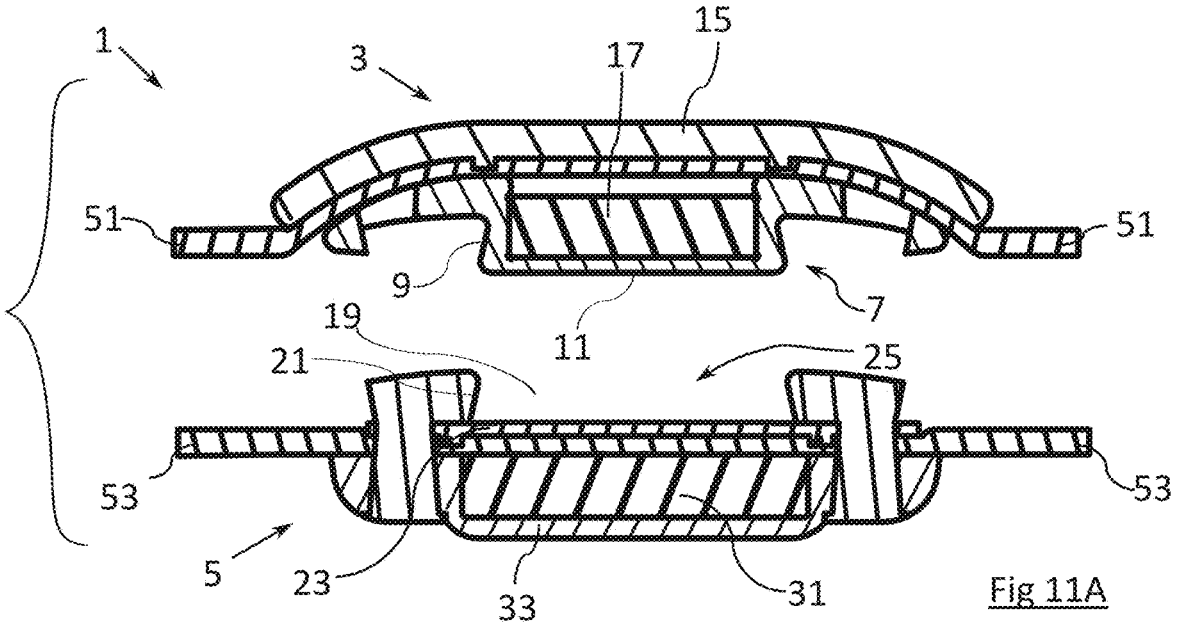
FIG. 11A is an enlarged view of FIG. 5 showing the male and female parts separated.
Figure 11B:
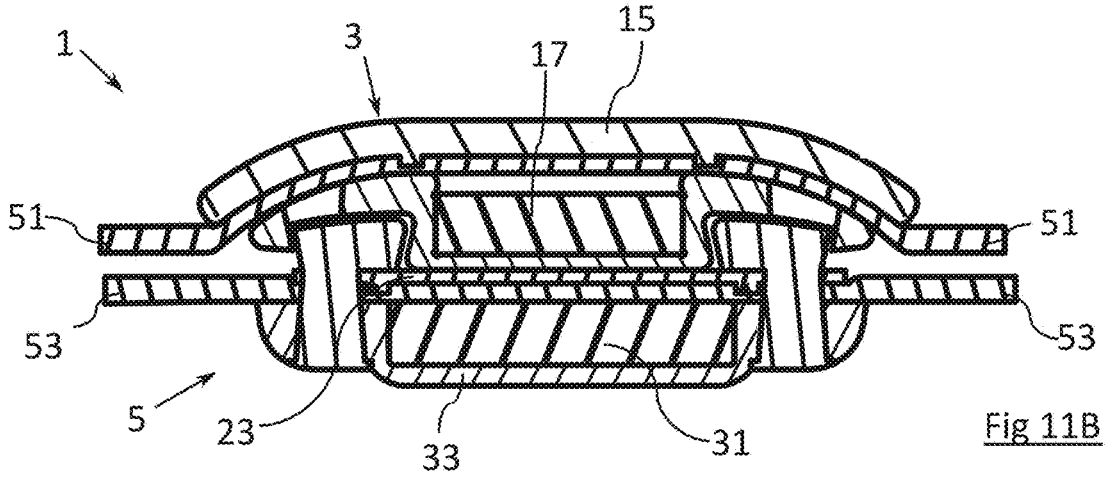
FIG. 11B is an enlarged view of FIG. 5.
Figure 12:
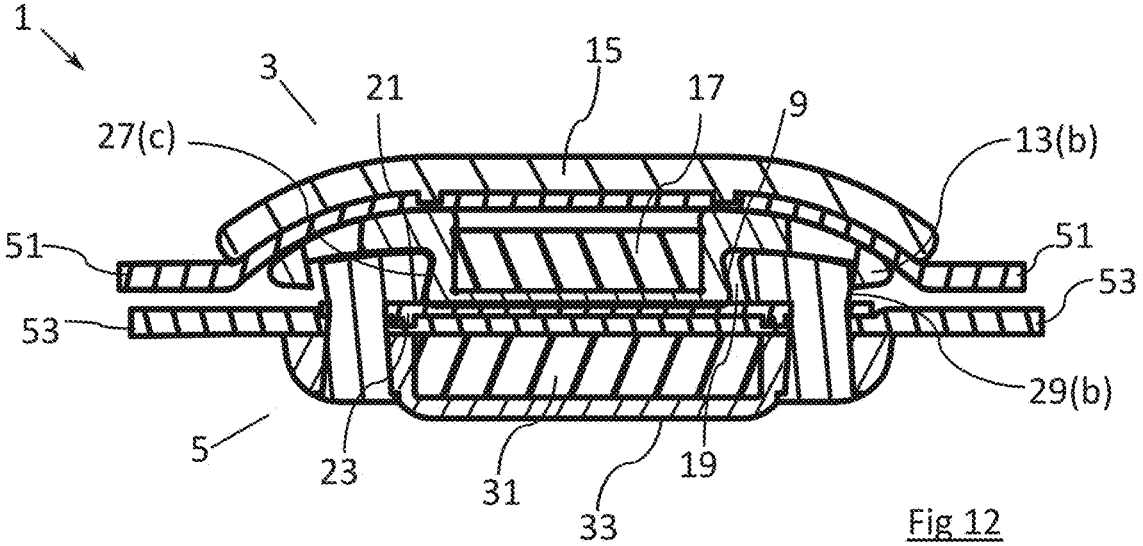
FIG. 12 is an enlarged view of FIG. 6.
Figure 13:
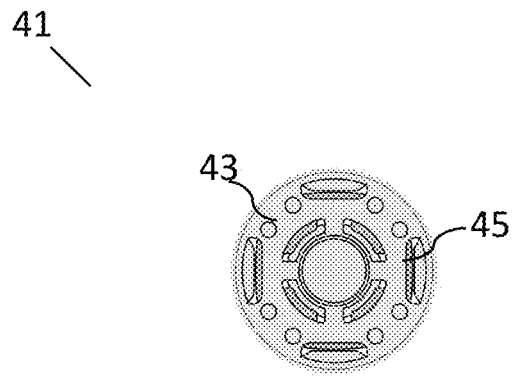
FIG. 13 is a top view of a second embodiment of the closure, in which the closure is in a neutral position.
Figure 14:
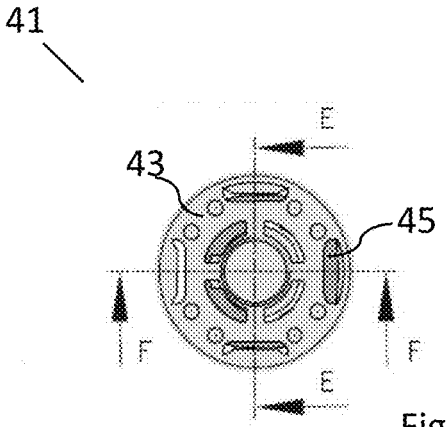
FIG. 14 is a top view of the second embodiment of the closure, in which the female part has been moved in the direction of arrow A of FIG. 16.
Figure 15:
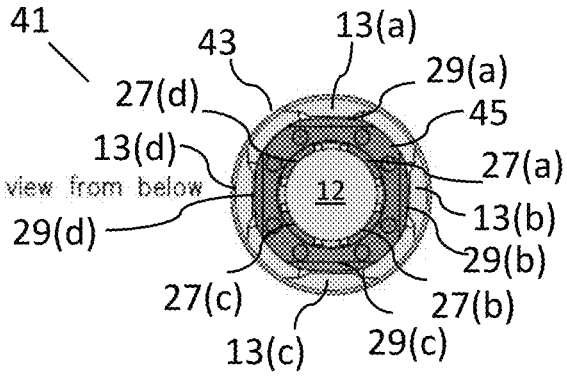
FIG. 15 is a bottom view of the closure of FIG. 13.
Figure 16:
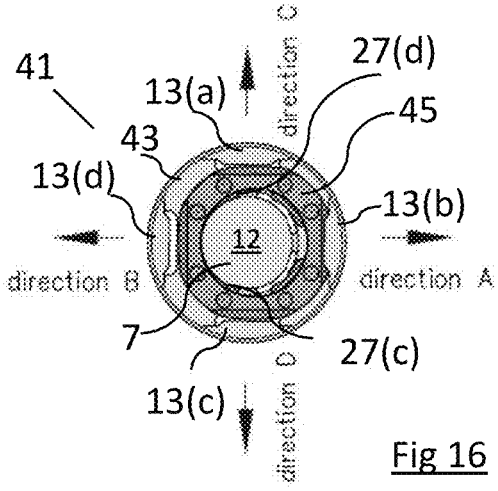
FIG. 16 is a bottom view of the closure of FIG. 14.
Figure 17:
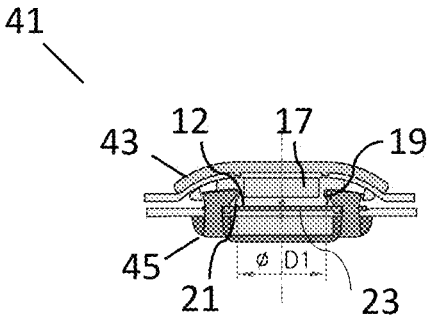
FIG. 17 is a cross-sectional view along the lines E-E of FIG. 14.
Figure 18:
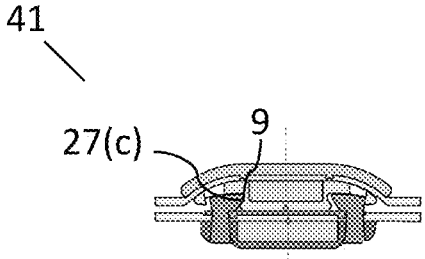
FIG. 18 is a cross-sectional view along the lines F-F of FIG. 14.
Figure 19:
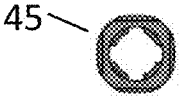
FIG. 19 is a reduced bottom view of a portion of the female part of the second embodiment of the closure.
Figure 20:
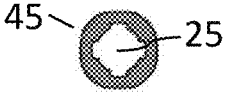
FIG. 20 is a reduced top view of a portion of the female part of the second embodiment.
Figure 21:
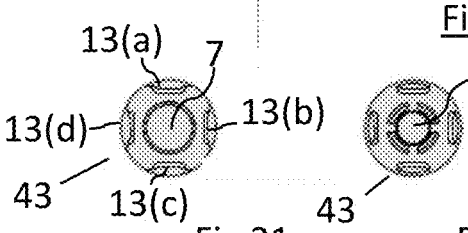
FIG. 21 is a reduced bottom view of the male part of the second embodiment of the closure.
Figure 22:
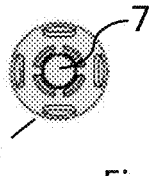
FIG. 22 is a reduced top view of the male part of the second embodiment.
Figure 23:
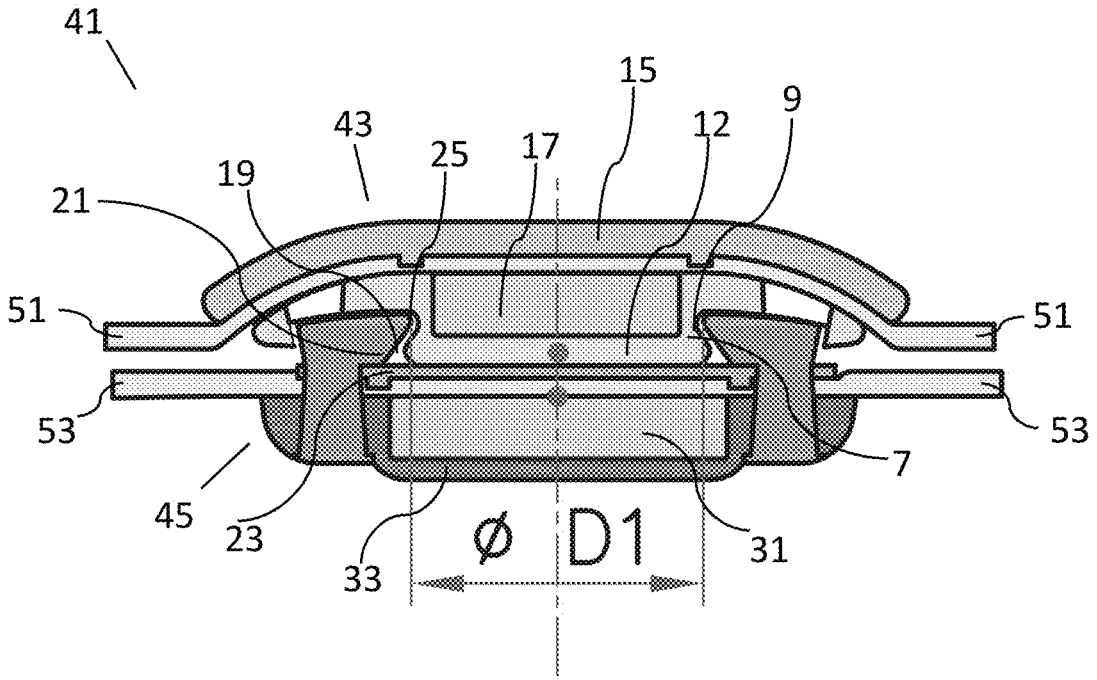
FIG. 23 is an enlarged view of FIG. 17.
Figure 24:
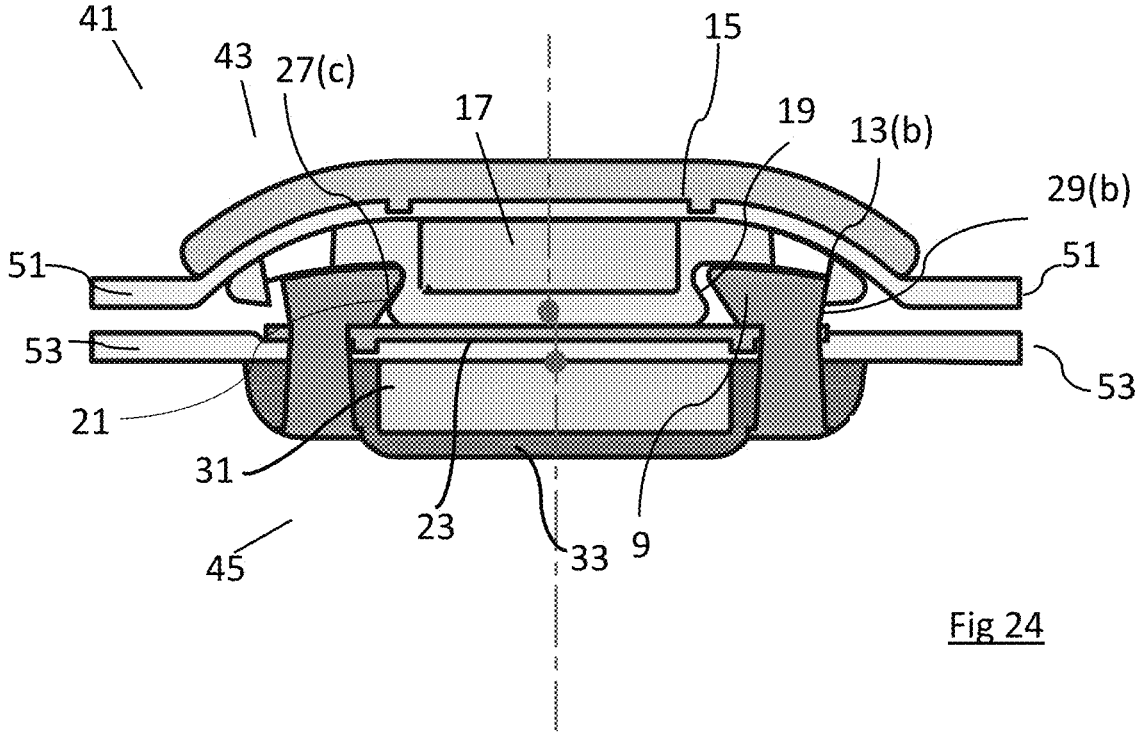
FIG. 24 is an enlarged view of FIG. 18.

Referring specifically to FIGS. 2, 4-6, 11A-B, and 12, the female part 5 is shown moved relative to the male part in the direction of arrow A in FIG. 4. The outwardly depending catch face 29(*b*) engages the interior face of the downwardly depending outer protuberance 13(*b*) and the side wall 9 of the main protuberance 7 engages with the inwardly depending catch faces 27(*c*) and 27(*d*). Further radial movement of the female part in the direction of arrow A will cause the two parts to become even more securely engaged. Due to the fact that the male part engages the female part towards the leading edge (i.e. the side wall) and the rear edge (the interior face of the outer protuberance) of the male part, the male part will not have a tendency to pivot about the leading edge resulting in inadvertent release. Instead, the male part will be held in position under greater forces than was heretofore the case. It will be understood that irrespective of the direction of radial force, at least one inwardly depending catch face and at least one outwardly depending catch face of the female part will engage with the male part.

Referring now to FIGS. 13-24, there is shown a second embodiment of a closure, indicated generally by the reference numeral 41, where like parts have been given the same reference numeral as before. The closure 41 comprises a male part 43 and a female part 45. The embodiment of FIGS. 13 to 24 differs from the embodiment shown in FIGS. 1 to 12 in that the diameter of the head 12 of the male part 43 of the closure 41 is greater than the diameter of the head 11 of the male part 3 the closure 1. Furthermore, the diameter of the head 12 of the male part 43 is greater than the diameter of the entrance 25 to the seat cavity 19 of the female part 45. This is perhaps best illustrated in FIGS. 17 and 23, wherein D1 indicates the diameter of entrance 25 to the seat cavity 19. In addition to the foregoing, the angle formed between the side wall 21 of the seat cavity and the base 23 of the seat cavity of the female part 45 of the closure 41 is more acute than the angle formed between the side wall 21 of the cavity and the base 23 of the seat cavity of the female part 5 of the closure 1.

In this way, the closure 41 will effectively "lock" into position once the main protuberance 7 of the male part 43 is inserted into the seat cavity 19 of the female part 45. The inwardly depending catch faces 27(*a*)-27(*d*) will be deflected outwardly to allow insertion of the head 11 of the main protuberance 7 into the seat cavity 19. Once the head 12 of the main protuberance is inside the seat cavity 19, the head 12 (more specifically the side wall 9 adjacent the head 12) and the inwardly depending catch faces 27(*a*)-27(*d*) will act to prevent inadvertent dislodgement of the male part 43 from the female part 45 in addition to the force of the magnets 17, 31.

Referring specifically to FIGS. 11A-B, 12, 23, and 24, the male part 3, 43 and the female part 5, 45 are each shown connected to a piece 51, 53, respectively. This may be a garment such as a jacket or a bag or other article. The male part 3, 43 and the female part 5, 45 may be stitched, welded, glued or attached in any known manner to the pieces 51, 53 respectively.

In the embodiments shown, the closures are shown with magnets in the male and female parts. However, this is preferred but not essential and it is envisaged that there is merit in a closure with the same construction as those shown in FIGS. 1 to 24 inclusive but without the magnets. A closure with magnets is seen as particularly useful for sportswear, whereas a closure without magnets is more suited to application in medical, fire department or working clothing. It will be understood that without the magnets, the closing position will have to be found by hand and therefore magnets may also be preferable when the closure is used for garments intended for the young, elderly, when the closure is in a difficult to reach position (such as behind the wearer's back) or for those persons with reduced manual dexterity.

In this specification the terms "comprise, comprises, comprised and comprising" and the terms "include, includes, included and including" are all deemed interchangeable and should be afforded the widest possible interpretation. As used in this application, the terms "about" or "approximately" refer to a range of values within plus or minus 10% of the specified number.

Further provided is a garment having a closure according to any of the aforementioned embodiments.

The embodiments of the multi-directional closure described herein are exemplary and numerous modifications, combinations, variations, and rearrangements can be readily envisioned to achieve an equivalent result, all of which are intended to be embraced within the scope of the appended claims. Further, nothing in the above-provided discussions of the closure should be construed as limiting the invention to a particular embodiment or combination of embodiments. The scope of the invention is defined by the appended claims.

We claim:

1. A multi-directional closure for securing two pieces together, the multi-directional closure comprising:

a female part configured to be mounted on one of the pieces and a male part configured to be mounted on the other of the pieces;

the female part comprising a seat cavity having an entrance which opens upwardly, the seat cavity having an internal diameter that increases from the entrance towards a base of the seat cavity;

the male part comprising a main protuberance which projects downwardly, the main protuberance having a diameter that increases from a base of the main protuberance towards a head of the main protuberance;

the female part further comprising four inwardly depending catch faces and four outwardly depending catch faces, the four inwardly depending catch faces being located at the entrance of the seat cavity, circumferentially spaced around the entrance of the seat cavity with respect to each other, and configured for releasable engagement of a side wall of the main protuberance of the male part, the four outwardly depending catch faces extending radially outwardly from the entrance of the seat cavity and being circumferentially spaced around the entrance of the seat cavity with respect to each other; and the male part further comprising four outer protuberances which project downwardly and are substantially evenly spaced apart from each other around the main protuberance, each of the outer protuberances having a catch face shaped complementary to and configured for releasable engagement with one of the outwardly depending catch faces of the female part.

2. The multi-directional closure of claim 1, wherein the female part has a female magnet adjacent the base of the seat cavity, and the male part has a male magnet adjacent the head of the main protuberance and configured for releasable engagement of the female magnet.

3. The multi-directional closure of claim 2, wherein the male magnet and the female magnets are sealed inside the male part and the female part, respectively.

4. A garment including the multi-directional closure of claim 2.

5. The multi-directional closure of claim 1, wherein the main protuberance is frustoconical in shape.

6. The multi-directional closure of claim 1, wherein the four inwardly depending catch faces of the female part are offset by about 45° with respect to the outwardly depending catch faces.

7. The multi-directional closure of claim 1, wherein the inwardly depending catch faces of the female part each extend between 55° and 65° around a circumference of the entrance of the seat cavity.

8. The multi-directional closure of claim 7, wherein the inwardly depending catch faces of the female part each extend 60° around the circumference of the entrance of the seat cavity.

9. The multi-directional closure of claim 1, wherein the diameter at the head of the main protuberance is greater than the internal diameter of the seat cavity at the entrance.

10. The multi-directional closure of claim 9, wherein the diameter at the head of the main protuberance is at least 0.00025 m (0.25 mm) greater than the internal diameter of the seat cavity at the entrance.

11. The multi-directional closure of claim 10, wherein the diameter at the head of the main protuberance is at least 0.0003 m (0.3 mm) greater than the internal diameter of the seat cavity at the entrance.

12. The multi-directional closure of claim 1, wherein the male part and the female part each have an outer diameter of between 0.014 m (14 mm) and 0.02 m (20 mm).

13. The multi-directional closure of claim 1, wherein the male part and the female part each include a backing plate.

14. The multi-directional closure of claim 1, further including a plurality of female parts.

15. The multi-directional closure of claim 1, further including a plurality of male parts.

16. A garment including the multi-directional closure of claim 1.

* * * * *